US007621052B1

(12) United States Patent
Kerr

(10) Patent No.: US 7,621,052 B1
(45) Date of Patent: Nov. 24, 2009

(54) BOLT CUTTER

(76) Inventor: David Scott Kerr, 7830 Laura La., White City, OR (US) 97503

( * ) Notice: Subject to any disclaimer, the term of this patent is extended or adjusted under 35 U.S.C. 154(b) by 327 days.

(21) Appl. No.: 11/805,567

(22) Filed: May 23, 2007

(51) Int. Cl.
*B26B 17/02* (2006.01)

(52) U.S. Cl. ..... 30/188; 30/250

(58) Field of Classification Search ..... 30/188, 30/238, 249, 250, 251; D8/52
See application file for complete search history.

(56) References Cited

U.S. PATENT DOCUMENTS

| | | | | |
|---|---|---|---|---|
| 2,643,564 | A | 6/1953 | Klein et al. | |
| 2,956,340 | A * | 10/1960 | Levenson | 30/272.1 |
| 2,993,275 | A | 7/1961 | Naito | |
| 3,084,432 | A | 4/1963 | Hill | |
| 3,624,903 | A | 12/1971 | Tibbet | |
| 3,949,473 | A * | 4/1976 | Blanc | 30/191 |
| 4,198,749 | A * | 4/1980 | Nordin | 30/192 |
| 4,254,549 | A | 3/1981 | McMullin | |
| 4,516,322 | A * | 5/1985 | Schlein | 606/101 |
| 6,769,183 | B2 | 8/2004 | Schmidt | |
| 2008/0163494 | A1 * | 7/2008 | Larkin | 30/187 |

* cited by examiner

*Primary Examiner*—Hwei-Siu C Payer
(74) *Attorney, Agent, or Firm*—Timothy E. Siegel Patent Law, PLLC

(57) ABSTRACT

A bolt cutter. An illustrative embodiment of the bolt cutter includes a first jaw having a first jaw cutting edge, a second jaw pivotal with respect to the first jaw and having a second jaw cutting edge, a first handle pivotally carried by the first jaw, a second handle pivotally carried by the first handle and the second jaw, a rotatable sprocket carried by a first one of the first handle and the second handle and a roller chain meshing with the sprocket and attached to a second one of the first handle and the second handle.

15 Claims, 2 Drawing Sheets

BOLT CUTTER

FIELD

The present invention relates to bolt cutters. More particularly, the present invention relates to a high-leverage bolt cutter.

BACKGROUND

Conventional bolt cutters typically include a pair of pivoting jaws which are selectively actuated by squeezing a pair of handles. The handles are typically elongated to facilitate manual application of sufficient leverage to the jaws in order to sever a workpiece such as a bolt or the like when the workpiece is inserted between the jaws. Due to their typically bulky size, conventional bolt cutters are frequently large and cumbersome to carry and store.

SUMMARY

The present invention is generally directed to a bolt cutter. An illustrative embodiment of the bolt cutter includes a first jaw having a first jaw cutting edge, a second jaw pivotal with respect to the first jaw and having a second jaw cutting edge, a first handle pivotally carried by the first jaw, a second handle pivotally carried by the first handle and the second jaw, a rotatable sprocket carried by a first one of the first handle and the second handle and a roller chain meshing with the sprocket and attached to a second one of the first handle and the second handle. The sprocket can be engaged for rotation by a ratchet wrench or the like to facilitate closing of the first and second jaws.

BRIEF DESCRIPTION OF THE DRAWINGS

The invention will now be described, by way of example, with reference to the accompanying drawings, in which.

DETAILED DESCRIPTION

Figures 1, 2, 3:
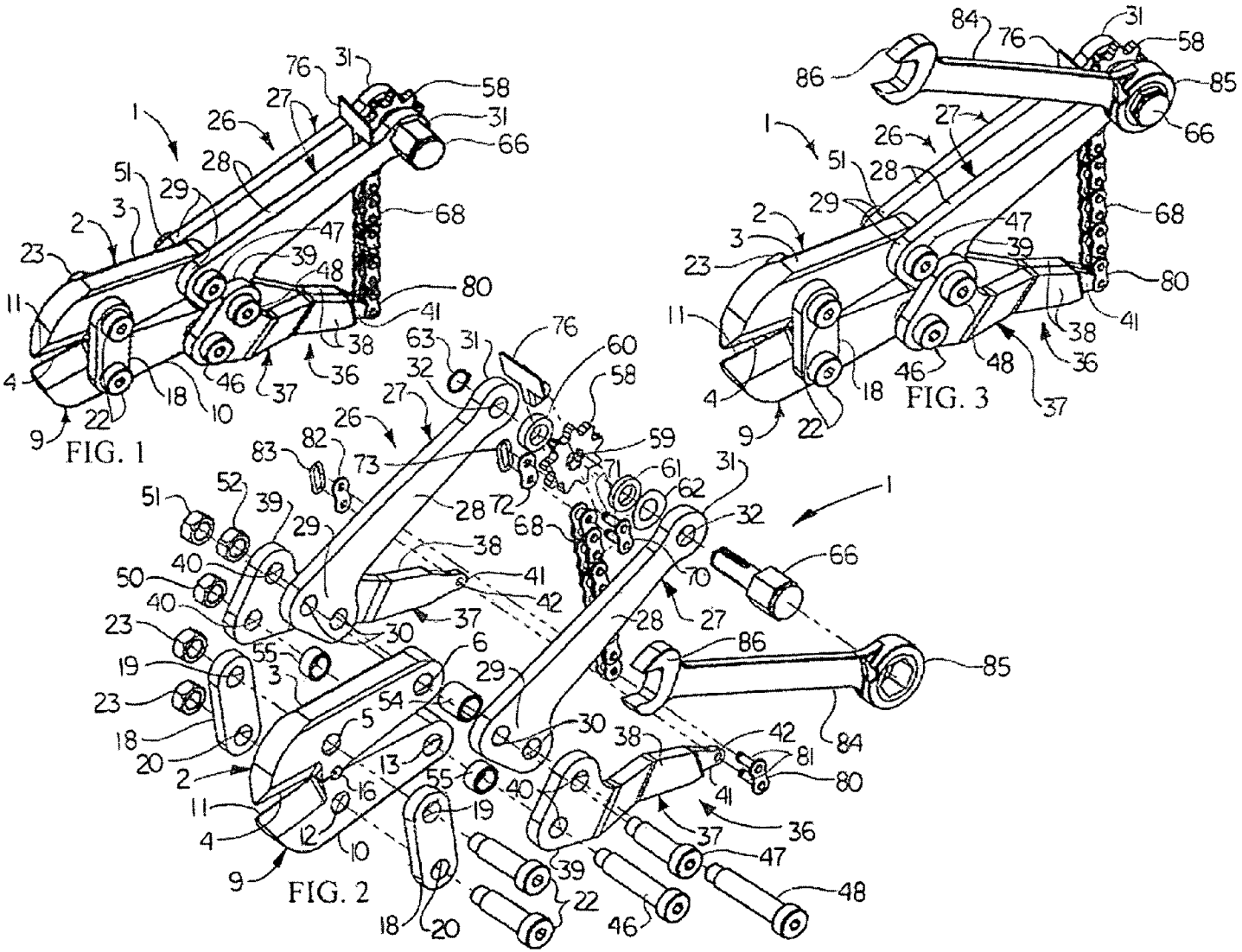
FIG. 1 is a perspective view of an illustrative embodiment of the bolt cutter.
FIG. 2 is an exploded, perspective view of an illustrative embodiment of the bolt cutter.
FIG. 3 is a perspective view of an illustrative embodiment of the bolt cutter, with a ratchet wrench engaging the bolt cutter preparatory to use of the bolt cutter.

Referring initially to FIGS. 1 and 2 of the drawings, an illustrative embodiment of the bolt cutter is generally indicated by reference numeral 1. It is to be understood that relative terms such as "upper" and "lower" used herein are intended to describe relative relationships of components with respect to each other and should not be construed in a limiting sense. Therefore, the components designated by such terms may be oriented in other spatial relationships with respect to each other during use of the bolt cutter 1.

The bolt cutter 1 includes an upper jaw 2 and a lower jaw 9 which are pivotally attached to each other at a pivot point 16, as illustrated in FIG. 2. The pivot pin 16 is typically encased in two semicircular cutouts (not numbered) provided in the upper jaw 2 and the lower jaw 9, respectively. The upper jaw 2 includes an upper jaw body 3 which may have a generally elongated configuration. An upper jaw cutting edge 4 is provided in the upper jaw body 3 of the upper jaw 2, generally at or adjacent to a front end of the upper jaw body 3. A handle fastener opening 6 extends through the upper jaw body 3, generally at or adjacent to a rear end of the upper jaw body 3. A link fastener opening 5 extends through the upper jaw body 3, between the upper jaw cutting edge 4 and the handle fastener opening 6.

The lower jaw 9 may be similar in construction to the upper jaw 2, including a lower jaw body 10 which may have a generally elongated configuration. A lower jaw cutting edge 11 is provided in the lower jaw body 10 of the lower jaw 9, generally at or adjacent to a front end of the lower jaw body 10. A handle fastener opening 13 extends through the lower jaw body 10, generally at or adjacent to a rear end of the lower jaw body 10. A link fastener opening 12 extends through the lower jaw body 10, between the lower jaw cutting edge 11 and the handle fastener opening 13. The pivot point 16 at which the upper jaw body 3 of the upper jaw 2 and the lower jaw body 10 of the lower jaw 9 are pivotally attached to each other may be, for example, a hardened dowel pin.

Jaw links 18 may be attached to respective sides of the upper jaw 2 and the lower jaw 9 to further connect the upper jaw 2 and the lower jaw 9 to each other. Each jaw link 18 includes a pair of spaced-apart fastener openings 19 and 20, respectively. A first link fastener 22, which may be a shoulder bolt, for example, is extended through the fastener openings 19 in the respective jaw links 18 and the registering link fastener opening 5 in the upper jaw body 3 of the upper jaw 2. A nut 23 is typically threaded on the first link fastener 22. In like manner, a second link fastener 22, which may be a shoulder bolt, for example, is extended through the fastener openings 20 in the respective jaw links 18 and the registering link fastener opening 12 in the lower jaw body 10 of the lower jaw 9. A nut 23 is typically threaded on the second link fastener 22.

An upper handle 26 and a lower handle 36 engage the upper jaw 2 and the lower jaw 9 to facilitate selective opening and closing of the upper jaw 2 and the lower jaw 9, as will be hereinafter described. The upper handle 26 includes a pair of generally elongated, parallel, spaced-apart upper handle members 27. Each upper handle member 27 typically includes a generally elongated upper handle shaft 28, an upper handle head 29 provided on a first end of the upper handle shaft 28 and an upper handle tail 31 provided on a second end of the upper handle shaft 28. The lower handle 36 may be similar in construction to the upper handle 26, including a pair of generally elongated lower handle members 37. Each lower handle member 37 typically includes a generally elongated lower handle shaft 38, a lower handle head 39 provided on a first end of the lower handle shaft 38 and a lower handle tail 41 provided on a second end of the lower handle shaft 38.

Each upper handle member 27 of the upper handle 26 is pivotally attached to both the upper jaw 2 and the lower handle 36. Moreover, each lower handle member 37 of the lower handle 36 is pivotally attached to the lower jaw 9. Therefore, movement of the upper handle 26 and the lower handle 36 toward and away from each other facilitates closing and opening, respectively, of the upper jaw 2 and the lower jaw 9 as the upper jaw 2 and the lower jaw 9 pivot toward and away from each other, respectively, via the pivot point 16 (FIG. 2).

The upper handle head 29 of each upper handle member 27 is pivotally attached to the upper jaw 2 typically via a handle fastener 47. Accordingly, as illustrated in FIG. 2, in some embodiments, a pair of spaced-apart head fastener openings 30 extends through the upper handle head 29 of each upper handle member 27. Likewise, a pair of spaced-apart head fastener openings 40 extends through the lower handle head 39 of each lower handle member 37. The handle fastener 47, which may be a shoulder bolt, for example, extends through one head fastener opening 30 in each upper handle member 27 and through the registering handle fastener opening 6 provided in the upper jaw body 3 of the upper jaw 2. A fastener nut 51 is typically threaded and secured on the handle fastener 47.

The upper handle heads 29 of the respective upper handle members 27 are pivotally attached to the lower handle heads 39 of the respective lower handle members 37 typically via a handle fastener 48, which may be a shoulder bolt, for example. Accordingly, as further illustrated in FIG. 2, in some embodiments, the handle fastener 48 is extended through a head fastener opening 40 in each lower handle head 39 and through the remaining registering head fastener opening 30 provided in each upper handle head 29. In some embodiments, the handle fastener 48 additionally extends through a wide handle spacer 54 which is interposed between the upper handle heads 29 of the respective upper handle members 27. A fastener nut 52 is typically threaded and secured on the handle fastener 48.

The lower handle head 39 of each lower handle member 37 is pivotally attached to the lower jaw 9 typically via a handle fastener 46 which may be a shoulder bolt, for example. Accordingly, as illustrated in FIG. 2, in some embodiments, the handle fastener 46 is extended through the remaining head fastener opening 40 provided in each lower handle head 39 and through the registering handle fastener opening 13 provided in the lower jaw 9. In some embodiments, the handle fastener 46 additionally extends through a pair of narrow handle spacers 55, each of which is interposed between the lower jaw 9 and the corresponding lower handle head 39. A fastener nut 50 is typically threaded and secured on the handle fastener 46.

A toothed sprocket 58 is rotatably mounted between the upper handle members 27 of the upper handle 26 using any suitable technique which is known by those skilled in the art. As illustrated in FIG. 2, in some embodiments a sprocket fastener opening 32 extends through the upper handle tail 31 of each upper handle member 27. A sprocket fastener opening 59 extends through the sprocket 58 and registers with the sprocket fastener openings 32. A wide sprocket spacer 60 is typically interposed between the sprocket 58 and one upper handle tail 31. A narrow sprocket spacer 61 is typically interposed between the sprocket 58 and the other upper handle tail 31. A spring washer 62 may be interposed between the narrow sprocket spacer 61 and the upper handle tail 31 for purposes which will be hereinafter described. A rotatable sprocket fastener 66 extends through the sprocket fastener opening 32 in each upper handle tail 31 and through the sprocket fastener opening 59 of the sprocket 58; the wide sprocket spacer 60; the narrow sprocket spacer 61; and the spring washer 62. The sprocket 58 may be attached to the sprocket fastener 66 using a key and keyway attachment, a pinned attachment or any suitable alternative attachment technique known by those skilled in the art. The sprocket fastener 66 may be any type of element which is capable of being selectively engaged and rotated to facilitate rotation of the sprocket 58. In some embodiments, the sprocket fastener 66 is a hex-headed sprocket bolt. A retaining ring 63 or other securing element is typically provided on the sprocket fastener 66 to retain the sprocket fastener 66 in place.

A generally T-shaped chain retention tab 76 is attached to a first or upper end of the roller chain 68 using any suitable attachment technique which is known by those skilled in the art. In some embodiments, a connecting link 70 includes a pair of spaced-apart connecting link pins 71. One of the connecting link pins 71 of the connecting link 70 extends through a chain opening (not numbered) provided in the roller chain 68. The other of the connecting link pins 71 of the connecting link 70 extends through a pin opening (not illustrated) provided in the chain retention tab 76. Connecting links 72, 73 receive and engage the respective connecting link pins 71 of the connecting link 70, typically in a snap-fit, to secure the attachment of the chain retention tab 76 to the roller chain 68. As illustrated in FIG. 1, when the roller chain 68 is disengaged from the sprocket 58, the chain retention tab 76 extends between the upper handle members 27 of the upper handle 26 and engages the upper surfaces of the upper handle shafts 28 adjacent to the sprocket 58. Therefore, when the roller chain 68 is disengaged from the sprocket 58, the chain retention tab 76 prevents the roller chain 68 from inadvertently slipping between the upper handle members 27 of the upper handle 26. The chain retention tab 76 is capable of sliding along the upper surface of the upper handle 26. In use, which will be hereinafter described, the roller chain 68 is capable of meshing with the sprocket teeth (not numbered) provided on the toothed sprocket 58, in which case the chain retention tab 76 hangs downwardly from and behind the sprocket 58.

The roller chain 68 may be attached to the lower handle members 37 of the lower handle 36 using any suitable technique which is known by those skilled in the art. As further illustrated in FIG. 2, in some embodiments, a connecting link 80 includes a pair of spaced-apart connecting link pins 81. One of the connecting link pins 81 of the connecting link 80 extends through a chain opening (not numbered) provided in the roller chain 68. The other of the connecting pins 81 of the connecting link 80 extends through a link pin opening 42 provided in each lower handle tail 41. Connecting links 82, 83 receive and engage the connecting link pins 81 typically in a snap-fit to secure attachment of the roller chain 68 to the lower handle 36.

In some embodiments, the positions of the sprocket 58 and the roller chain 68 are reversed. Therefore, the sprocket fastener 66 and sprocket 58 are provided on the lower handle 36 rather than the upper handle 26 and the roller chain 68 is attached to the upper handle 26 rather than the lower handle 36. Furthermore, the chain retention tab 76 engages the lower handle 36 rather than the upper handle 26.

Figure 5:
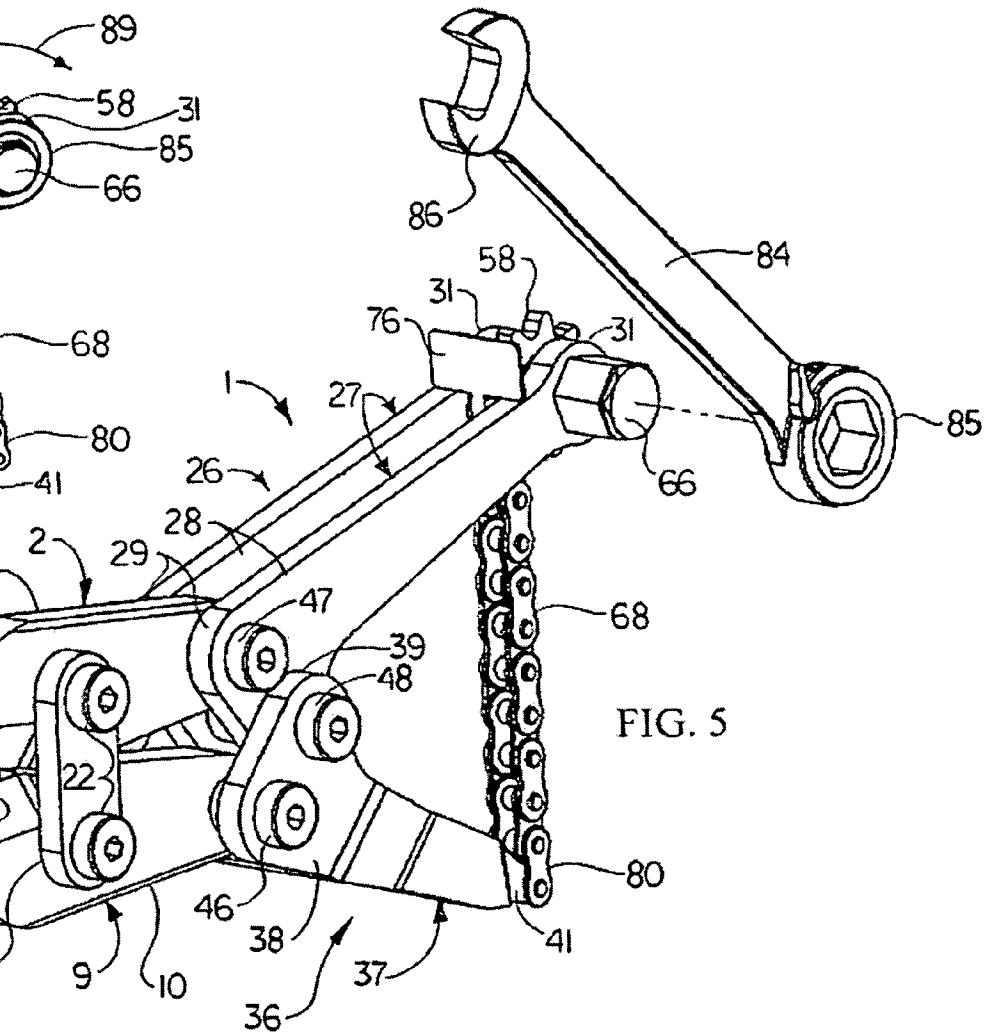
FIG. 5 is a perspective view of an illustrative embodiment of the bolt cutter, more particularly illustrating, in exploded view, typical engagement of the ratchet wrench with the bolt cutter.
Figure 4:
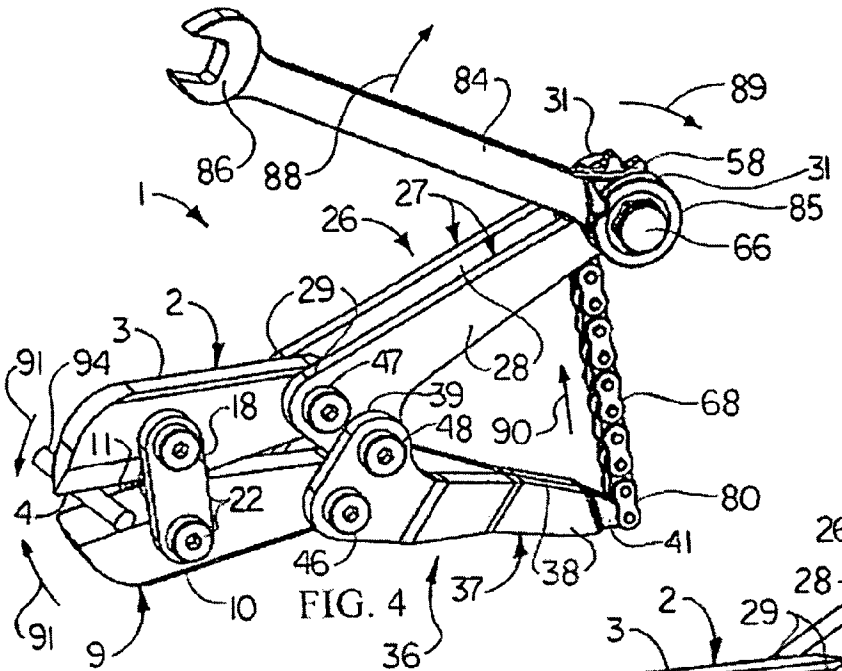
FIG. 4 is a perspective view of an illustrative embodiment of the bolt cutter, with a ratchet wrench engaging the bolt cutter and more particularly illustrating movement of upper and lower jaws of the bolt cutter toward each other responsive to rotation of the ratchet wrench.

Referring next to FIGS. 2-5 of the drawings, in typical application, the bolt cutter 1 is used to cut or sever a metal workpiece 94 (FIG. 4) such as thick wire or a bolt, for example. Accordingly, a wrench socket 85 of a ratchet wrench 84 is adapted to receive and engage the sprocket fastener 66, as illustrated in FIGS. 2 and 5. The ratchet wrench 84 has a free end 86 which is spaced-apart from the wrench socket 85. In some embodiments, the sprocket fastener 66 is a hex-headed sprocket bolt, in which case the wrench socket 85 is a hex-headed wrench socket. With the upper handle 26 and the lower handle 36 and the upper jaw 2 and the lower jaw 9 disposed in the open, separated or spread-apart configuration, the workpiece 94 is initially positioned between the upper jaw cutting edge 4 of the upper jaw 2 and the lower jaw cutting edge 11 of the lower jaw 9. A user (not illustrated) initially grasps the chain retention tab 76 and then lifts and drapes the roller chain 68 over the sprocket 58, meshing the roller chain 68 with the sprocket teeth (not numbered) on the sprocket 58. The ratchet wrench 84 is initially oriented such that the free end 86 of the ratchet wrench 84 is positioned forward of the sprocket 58. One hand (not illustrated) of the user grips the ratchet wrench 84 while the other hand (not illustrated) of the user typically grips the upper jaw 2 and the lower jaw 9 behind the jaw links 18. As the ratchet wrench 84 is next rotated in the clockwise direction indicated by the arrow 88 in FIG. 4, the sprocket 58 is also rotated as indicated by the arrow 89 such that the roller chain 68 is progressively wound on the sprocket 58 and shortens between the upper handle 26 and the lower handle 36, as indicated by the arrow 90. During the return stroke of the ratchet wrench 84, the spring washer 62 prevents reverse rotation of the sprocket 58 by applying an axial force which compresses the sprocket 58 between the wide sprocket spacer 60 and the narrow sprocket spacer 61. Therefore, frictional resistance which is applied against the sprocket 58 by the wide sprocket spacer 60 and the narrow sprocket spacer 61 prevents rotation of the sprocket 58 under the light force applied by the ratchet wrench 84 during its return stroke but is easily overcome by the force applied by the ratchet wrench 84 during the cutting stroke. At this point, the chain retention tab 76 hangs downwardly from the roller chain 68, behind the sprocket 58. Consequently, the upper handle 26 and the lower handle 36 move toward each other and pivot with respect to each other along the handle fastener 48 as the upper handle 26 pivots with respect to the upper jaw 2 along the handle fastener 47 and the lower handle 36 pivots with respect to the lower jaw 9 along the handle fastener 46. Therefore, the pivoting upper handle 26 and lower handle 36 actuate pivoting movement of the upper jaw 2 and the lower jaw 9 toward each other via the pivot point 16 (FIG. 2), as indicated by the arrows 91 in FIG. 4. Thus, the upper jaw cutting edge 4 and the lower jaw cutting edge 11 initially clamp and then sever or cut the workpiece 94.

Opening of the upper jaw 2 and the lower jaw 9 is accomplished by initially manually lifting and disengaging the roller chain 68 from the sprocket 58 and then extending the roller chain 68 between the upper handle members 27 of the upper handle 26 until the chain retention tab 76 again engages the upper surfaces of the upper handle members 27, with the roller chain 68 again extending downwardly from between the upper handle members 27. Therefore, the upper jaw 2 and the lower jaw 9 are opened preparatory to a subsequent cut.

It will be appreciated by those skilled in the art that application of the ratchet wrench 84 to rotate the sprocket 58 facilitates application of a high magnitude of leverage to the upper jaw 2 and the lower jaw 9 in cutting of the workpiece 94. Consequently, the bolt cutter 1 can be fabricated in smaller sizes than is the case with regard to conventional bolt cutters which typically require a larger size to facilitate application of sufficient manual leverage to the bolt cutter handles in order to cut or sever the workpiece. Furthermore, because the free end 86 of the ratchet wrench 84 is positioned forwardly of the sprocket 58 when the upper jaw 2 and the lower jaw 9 are open, the overall size of the bolt cutter 1 is reduced, thus facilitating space-efficient carrying and storage of the bolt cutter 1. Moreover, when the bolt cutter 1 is not in use, the wrench socket 85 of the ratchet wrench 84 can typically be disengaged from the sprocket fastener 66 and stored separately from the bolt cutter 1, as desired.

While the preferred embodiments of the invention have been described above, it will be recognized and understood that various modifications can be made in the invention and the appended claims are intended to cover all such modifications which may fall within the spirit and scope of the invention.

What is claimed is:

1. A method of cutting through an object, comprising:

(a) providing a cutting device, including:

(i) a first assembly and a second assembly hinged together, both first and second assemblies having a cutting head, defining a cutting edge, and a handle and wherein said hinge is located between said cutting head and said handle for both said first and second assemblies, and wherein said two cutting edges are mutually opposed and can be moved into physical engagement by moving said handles together, said movement of said cutting edges defining a cutting plane;

(ii) wherein a wheel is rotatably mounted to said handle of said first assembly, and wherein a tension member is engaged to said wheel and is also attached to said handle of said second assembly, so that when said wheel is turned in a first rotational direction, said first handle and said second handle are pulled together by said tension member, thereby bringing said cutting edges together; and (iii) a bolt rigidly attached to said wheel, so that turning said bolt turns said wheel; and (b) providing a wrench;

(c) fitting said wrench to said bolt and turning said wrench in a plane parallel to said cutting plane, thereby turning said bolt in said first rotational direction, thereby turning said wheel in said first rotational direction, thereby pulling said handles together and bringing said cutting edges together.

2. The method of claim 1, wherein said handles are substantially equal length and said wheel is mounted at the distal end of said handle of said first assembly.

3. The method of claim 2, wherein the step of fitting said wrench to said bolt, further includes fitting said wrench to said bolt so that said wrench forms an acute angle to said first handle and wherein said bolt is turned so that said wrench passes through a range of acute angles to said first handle, thereby permitting said object to be cut when only limited quarters are available for hosting said cutting device.

4. The method of claim 1, wherein said wheel is a sprocket having teeth and said tension member is a length a roller chain engaged to said teeth of said sprocket.

5. The method of claim 4, wherein said handle of said first assembly is made up of two spaced apart elements, defining a gap therebetween, and wherein said sprocket is mounted between said two spaced apart elements, and said chain is threaded between said two spaced apart elements and wherein said chain terminates in a retention element that is wider than said gap to prevent said chain from falling through said gap.

6. The method of claim 1, wherein said wrench is a ratchet wrench.

7. A cutting device, including:

a) a first assembly and a second assembly hinged together, both first and second assemblies having a cutting head, defining a cutting edge, and a handle and wherein said hinge is located between said cutting head and said handle for both said first and second assemblies, and wherein said two cutting edges are mutually opposed and can be moved into physical engagement by moving said handles together, said movement of said cutting edges defining a cutting plane;

b) wherein a wheel assembly is rotatably mounted to said handle of said first assembly, and wherein a tension member is engaged to said wheel assembly and is also attached to said handle of said second assembly, so that when said wheel assembly is turned in a first rotational direction said first handle and said second handle are pulled together by said tension member, thereby bringing said cutting edges together; and c) a ratchet arm attached to said wheel assembly, so that when said ratchet arm is turned in a plane parallel to said cutting plane and in said first rotational direction it turns said wheel assembly, and when the ratchet arm is turned in the opposite rotational direction it does not turn said wheel assembly, said ratchet arm having a range of rotational freedom that includes positions forming an acute angle between said ratchet arm and said handle of said first assembly.

8. The cutting device of claim 7, wherein said ratchet arm is removable from said wheel assembly.

9. The cutting device of claim 7, wherein said wheel assembly includes a bolt and a wheel, rigidly attached together by an axle that is threaded through a hole in said handle of said first assembly and wherein said ratchet arm is attached to said bolt.

10. The cutting device of claim 7, wherein said handles are substantially equal length and said wheel assembly is mounted at a distal end of said handle of said first assembly.

11. The cutting device of claim 10 wherein said ratchet arm is free to move through a range of acute angles, defined relative to said handle of said first assembly.

12. The cutting device of claim 7, wherein said wheel assembly includes a sprocket having teeth and said tension member is a length of roller chain engaged to said teeth of said sprocket.

13. The cutting device of claim 12, wherein said handle of said first assembly is made up of two spaced apart elements, defining a gap therebetween, and wherein said sprocket is mounted between said two spaced apart elements, and said chain is threaded between, said two spaced apart elements and wherein said chain terminates in a retention element that is wider than said gap to prevent said chain from falling through said gap.

14. A cutting device, comprising:

a) a first cutting head and a second cutting head, each cutting head having a distal portion and a proximal end and wherein said distal portion of said first cutting head defines a first cutting edge and said distal portion of said second cutting head defines a second cutting edge opposed to said first cutting edge;

b) a pair of cutting head links, to which each said cutting head is hinged, so that when said proximal ends of said cutting heads are forced apart, said distal portions are forced together, the movement of said distal portions defining a cutting plane;

c) a first handle hinged to said proximal end of said first cutting head and a second handle hinged to said proximal end of said second cutting head and also hinged to said first handle, whereby when said handles are forced together, said cutting head proximal ends are forced apart, forcing together said cutting edges;

d) wherein said first handle is made of two spaced apart members, defining a gap therebetween and wherein a sprocket is mounted between said two spaced apart members and is attached to a bolt that is threaded through a bolt hole in one of said spaced apart members so that the bolt head extends out of the exterior side of said bolt hole, thereby providing an attachment point for a ratchet arm to be moved in a plane parallel to said cutting plane; and e) wherein a portion a roller chain is attached to said second handle, threaded through said gap and can be engaged to said sprocket.

15. The cutting device of claim 14, wherein said portion of the roller chain terminates in a member that is larger in transverse dimension than said gap, so that when said roller chain portion is disengaged from said sprocket creating a free end, said free end cannot slip through said gap.

* * * * *

UNITED STATES PATENT AND TRADEMARK OFFICE

CERTIFICATE OF CORRECTION

PATENT NO. : 7,621,052 B1
APPLICATION NO. : 11/805567
DATED : November 24, 2009
INVENTOR(S) : David Scott Kerr It is certified that error appears in the above-identified patent and that said Letters Patent is hereby corrected as shown below:

Col. 6, Claim 4, Line 45 and Col. 8, Claim 14, Line 31, the second occurrence of "a", should read --of a--.

Signed and Sealed this

Seventeenth Day of August, 2010

David J. Kappos

David J. Kappos
*Director of the United States Patent and Trademark Office*